United States Patent [19]

Adams et al.

[11] 4,295,254

[45] Oct. 20, 1981

[54] TRANSMISSION LINE CABLE APPLICATOR MACHINE

[75] Inventors: John E. Adams, Mechanicsburg; Robert F. Evans, New Cumberland; John H. Gavin, Lancaster, all of Pa.

[73] Assignee: E. I. Du Pont de Nemours and Company, Wilmington, Del.

[21] Appl. No.: 940,620

[22] Filed: Sep. 8, 1978

[51] Int. Cl.[3] ..... H01R 43/00

[52] U.S. Cl. ..... 29/33 M; 29/566.1; 29/749

[58] Field of Search ..... 29/33 M, 566.1, 749, 29/750, 751, 752, 753, 754

[56] References Cited

U.S. PATENT DOCUMENTS

| | | | |
|---|---|---|---|
| 3,677,116 | 7/1972 | Berg et al. | 83/55 |
| 3,706,241 | 12/1972 | Balmer et al. | 81/9.51 |
| 3,845,535 | 11/1974 | Over . | |
| 3,988,815 | 11/1976 | Petree | 29/749 X |
| 4,005,921 | 2/1977 | Hadden et al. | 339/14 R |
| 4,017,954 | 4/1977 | Grubb | 29/749 |
| 4,020,540 | 5/1977 | Casciotti et al. | 29/749 |
| 4,035,897 | 7/1977 | Over et al. | 29/749 X |

*Primary Examiner*—Z. R. Bilinsky

[57] ABSTRACT

A machine for terminating flat multi-conductor transmission line cable to a connector. The machine includes a wire locator for providing semi-automatic positioning of cable shield wires and signal wires for terminations to a buss bar and connector tails respectively. The machine facilitates a method of mass termination of cable wires to a connector, which includes first stripping the cable to expose shield and signal wires, then positioning the cable wires in the machine for termination of shield and signal wires to the connector. The signal wires are terminated first to terminal tails extending from the connector. This is followed by the reverse bending of the shield wires over the buss bar and termination of the shield wires to the bar. In this fashion, the multiple wires of the cable may be simultaneously positioned, and respective sets of signal and shield wires mass terminated by the machine.

3 Claims, 9 Drawing Figures

TRANSMISSION LINE CABLE APPLICATOR MACHINE

DESCRIPTION

1. Technical Field

This invention relates to a machine for terminating flat multi-conductor transmission line cable to connectors, particularly wherein shield and signal conductors must be carefully positioned prior to termination. More particularly, the invention relates to the simultaneous selective positioning and mass termination of cable shield and signal conductors.

2. Background Art

Terminations of flat multi-conductor transmission cables to connectors have heretofore involved highly labor-intensive efforts. This is particularly true in the case of the more recently developed multi-conductor shielded cables which include a pair of juxtaposed shield conductors on each side of each signal conductor. The labor involves the fanning (spreading apart, typically by hand) of alternately positioned exposed shield and signal conductors to opposite sides of a connector surface, such surface typically consisting of a circuit board having traces printed on both sides. For example, the I/O Transmission Line Connector (Du Pont Berg Electronics Bulletin #123 dated March 1976) includes such a circuit board interface, requiring the fanning of respective alternate conductors to opposite sides of a board for subsequent soldering to traces printed on the board.

A second drawback of such termination lies in the impedance losses associated with the removal of signal and shield wires from the same plane. In the cable, all wires are in the same plane. In terminating, however, the exposed signal conductor ends are placed on one side of the circuit board, and the exposed shield conductor ends on the other side. Thus, after termination the signal and shield conductor ends lie in separate planes. The result is that in the region of termination, the shield conductor wires no longer "shield" the signal conductor wires. Impedance losses occur thereby, which are proportional to the length of unprotected signal wire, and are often quite high in situations requiring transmission line cable terminations involving opposite sides of a circuit board.

DISCLOSURE OF INVENTION

The machine described and claimed herein provides means for terminating flat multi-conductor transmission line cables to a connector without the labor-intensive requirement of fanning the exposed conductor ends.

The machine provides an efficient mass termination technique which affords minimal impedance losses via the use of short length terminations which involve only one surface of a connector, as opposed to the two sides of a circuit board.

The machine includes a wire locator which provides a semi-automatic positioning of transmission line cable shield (alternately and hereafter called "ground") and signal wires for terminations to a buss bar and connector terminal tails respectively. The machine has a bearing system and attached hand-operated lever which cooperate to provide cyclical movement of a punch assembly supported by punch guides extending from the base of the machine. A slide located on the base of the machine cooperates with the wire locator for the positioning of stripped flat cable intermediate the guides for termination of exposed cable wires to a connector positioned in a recess in the slide. The punch assembly contains separate signal and ground wire means for terminating signal and ground wires, respectively, at the end of separate strokes of the punch assembly.

A method of terminating multi-conductor flat transmission line cable to a connector illustrates the utility of the machine, and is as follows.

First, a cable is stripped at a portion intermediate the ends thereof by removal of insulation from a predetermined length to expose bare cable wires. A connector is seated in the recess of the slide of the machine. Next the exposed cable wires are positioned longitudinally within the wire locator guides of the machine, so that the exposed cable signal wires lie over terminal tails extending from a connector positioned in the recess. The cable is then clamped to the slide with a cable clamp. A buss bar is then seated into the connector for insertion into the connector. The lever of the machine is then stroked through one cycle. This moves the punch assembly through one cycle during which (1) the buss bar is pressed into position laterally across an insulated portion of the cable, thus clamping the cable to the connector, (2) the signal wires are terminated to the terminal tabs extending from the connector, and (3) the signal wires are cut. The unclamped end of the cable is then folded over the buss bar toward the clamped end of the cable. This reverse bends the ground wires which then lie over the buss bar. The lever is then stroked through another cycle, during which the cable ground wires are terminated to the buss bar and cut.

DETAILED DESCRIPTION OF PREFERRED EMBODIMENT

Figure 1:
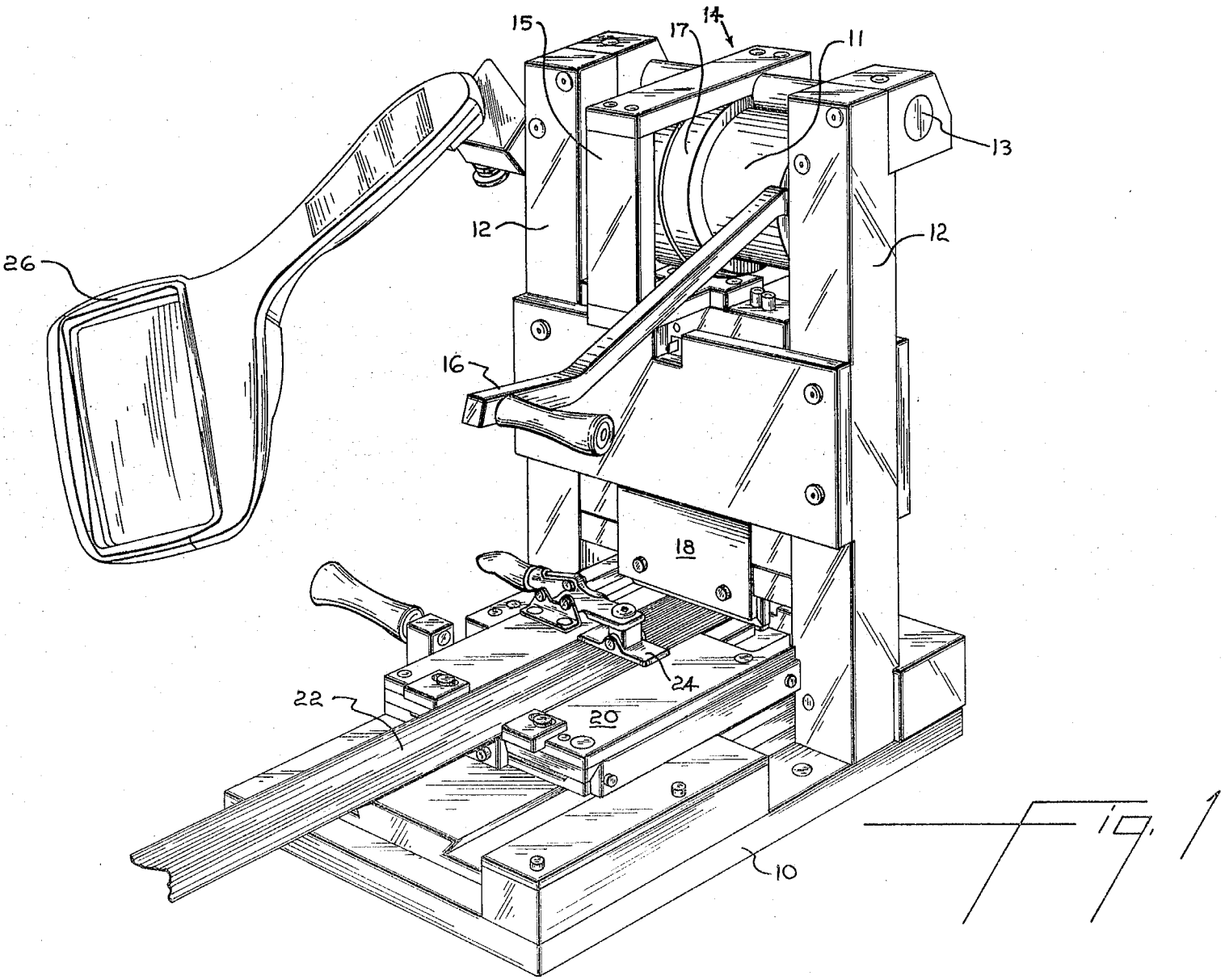
FIG. 1 is a perspective overall view of the transmission line cable applicator machine with a stripped cable clamped thereto.

A preferred embodiment of the applicator machine of this invention is shown in FIG. 1. Extending from a base 10 are a pair of punch guides 12 which support a roller bearing assembly 14. A lever 16 is attached to and extends from a cylinder 11 of the roller bearing assembly 14. The assembly 14 includes a roller-bearing 17 which surrounds the cylinder 11, a shaft 13, and a rectangular lifting jig 15. As the lever is raised or lowered, the cylinder 11 pivots about the shaft 13, thus correspondingly raising or lowering the jig 15 via the roller-bearing 17. Attached to the jig 15 is a punch assembly 18 which moves through a vertical stroke between the punch guides 12 as the lever 16 is moved between extreme positions. A slide 20 is movable across the base 10 to the punch assembly 18. A stripped cable 22 is shown clamped to the slide 20 by clamp 24. A magnifying lens 26 is attached to one of the punch guies 12 to permit an enlarged view of the termination process.

Figure 2:
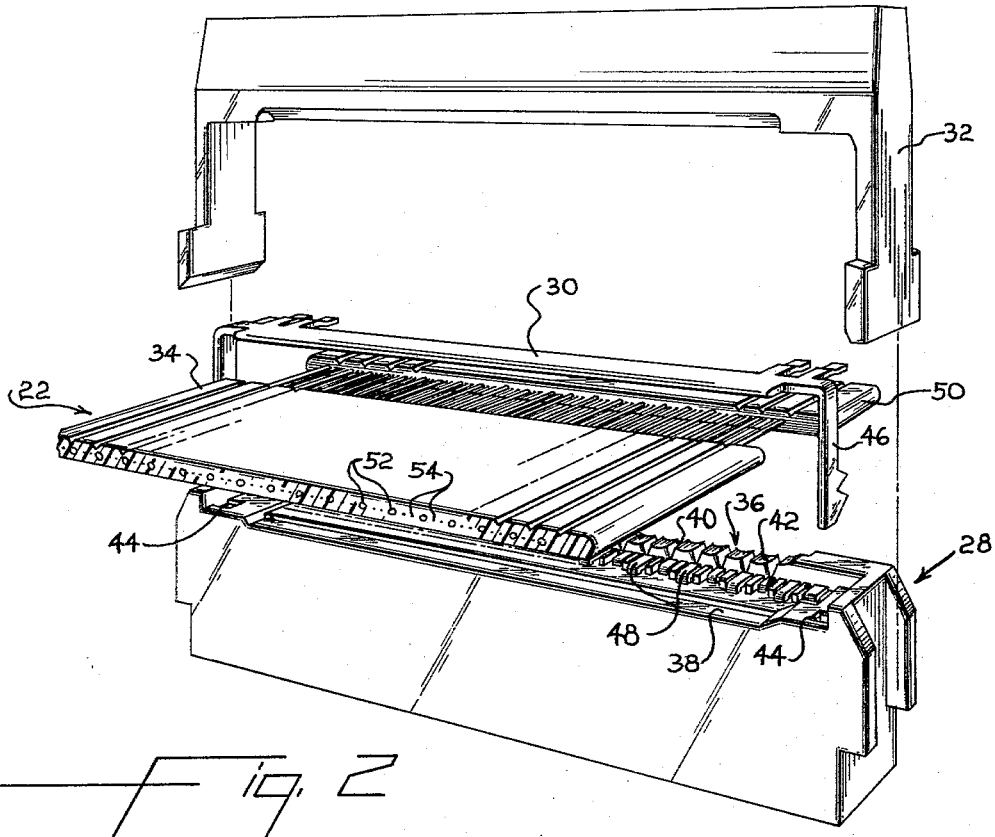
FIG. 2 is an exploded perspective view of a transmission line cable connector which includes detail of how a portion of stripped cable fits between the connector buss bar and strain relief.

The machine of this invention involves the termination of multi-conductor flat transmission line cable to a connector. FIG. 2 depicts an embodiment of a preferred connector 28 for the termination process herein described. The connector is described in U.S. Pat. No. 4,005,921, and includes a buss bar 30 and strain relief 32 which fits over the stripped cable 22 upon completion of the termination process. The connector has a cable terminating face 36 which includes a laterally extending surface 38 for receiving an insulated segment 34 of the cable, and which also includes a plurality of V-shaped grooves 40 between scalloped raised portions 42. The grooves 40 and scalloped raised portions 42 are singularly juxtaposed in an alternating arrangement, there being one groove between one raised portion. An opening 44 extends into each side of the body of the connector 28 for receiving a leg 46 of the buss bar 30. Terminal tails 48 extend from each individual terminal (not shown) within the connector. The tails 48 lie flat on the cable terminating face 36, each tail being in longitudinal alignment with a groove 40. Thus, each groove 40 and each tail 48 is in position to receive an exposed signal wire from a transmission line cable. The transmission line cable 22 includes an insulating sheath 50 and a plurality of signal wires 52 separated by a plurality of ground wires 54; there being two ground wires between each signal wire as shown.

Figure 3:
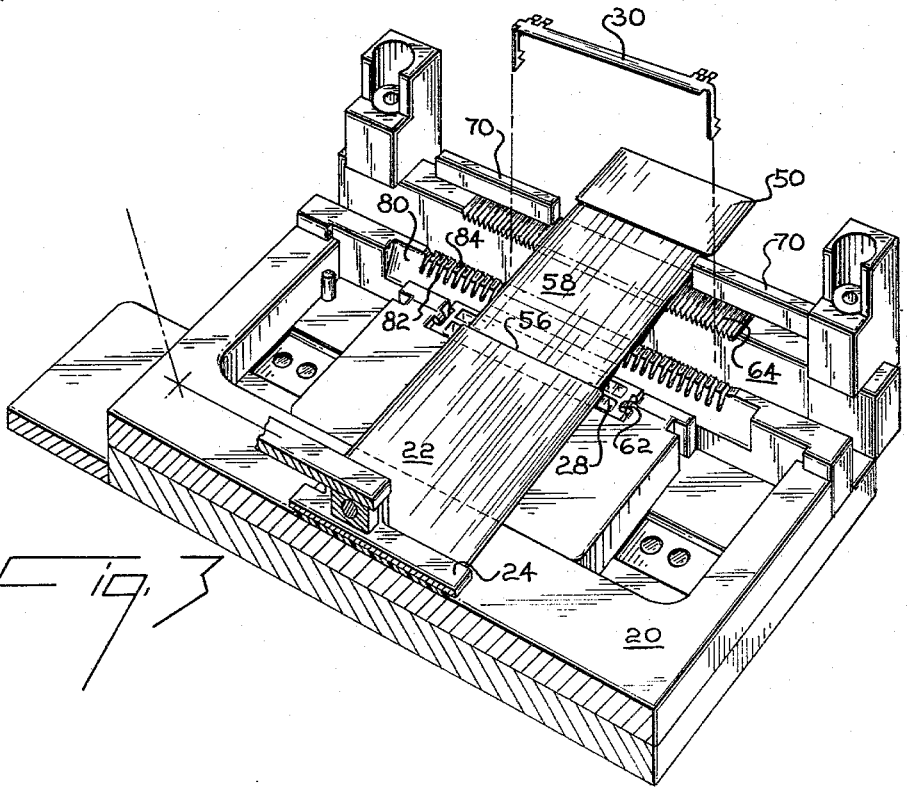
FIG. 3 is a sectioned perspective of a portion of the base and slide of the applicator machine of this invention, which includes detail of a connector positioned within a recess in the slide for termination to the overlying stripped cable.

The stripped cable 22 is shown clamped to the slide 20 in FIG. 3. The cable 22 may be stripped by severing the insulation sheath 50 laterally across its width at line 56, sliding the sheath forward along the conductors 58 to expose a segment of the conductors intermediate the ends of the cable. A connector 28 is shown positioned in recess 62 for termination to the stripped cable.

Figure 8:
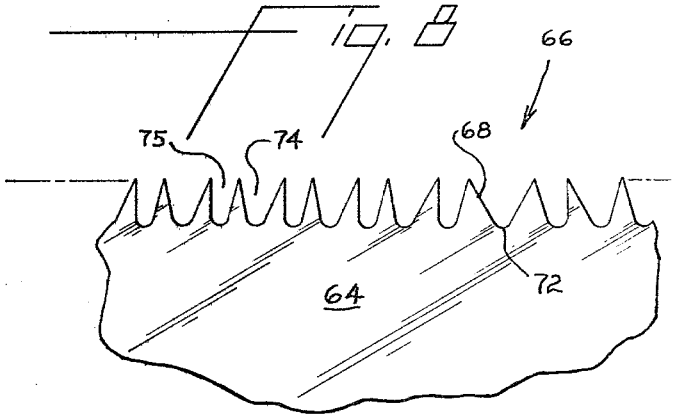
FIGS. 8 and 9 are sectioned face profiles of wire locator teeth as adapted for (1) flat cable having a width equal to or less than nominal specification, and (2) flat cable having a width equal to or greater than nominal specification, respectively.
Figure 9:
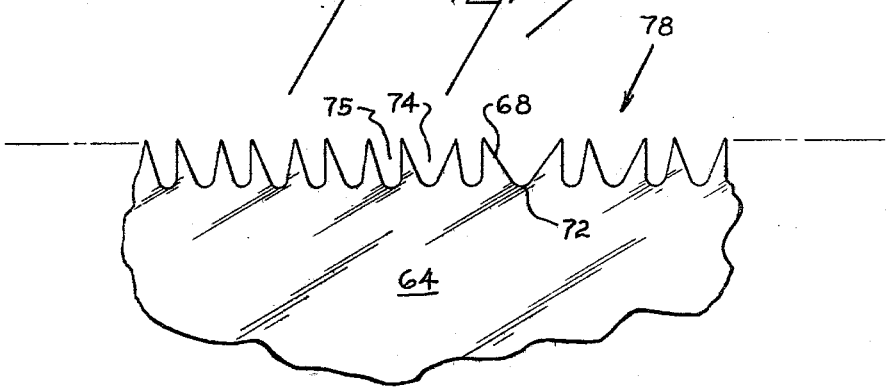

The exposed signal and ground cable wires are properly aligned for termination by a wire locator 64 having teeth which compensate for deviation from nominally specified cable width. The preferred embodiment of the machine utilizes two such locators, one for use when the cable is equal to or wider than the nominal width specification, the other for use when the cable is equal to or narrower than the nominal width specification. Profiles of the two wire locators, are shown in FIGS. 8 and 9. Profile 66 of FIG. 8 is for use with cables having a width equal to or narrower than nominal specification. Teeth 68 are arranged to spread the exposed wires of a narrow cable to the nominal cable width value. Referring again to FIG. 3, wire guide 70 first centers the cable so that the two centermost ground wires of the exposed segment 58 of the cable are positioned to lie within the centermost notch 72 (FIG. 8) of the wire locator. The teeth 68 are spread farthest apart at notch 72 so that notch 72 is wider than any other notch. In alternating fashion, a signal wire and two ground wires lie between adjacent teeth in alternating fashion from centermost notch 72 outwardly toward both edges of the wire locator 64. As may be seen, the ground wires fall into the wider notches 74, while the signal wires fall into the narrower notches 75. Note that the teeth of profile 66 tend to point inwardly on both sides of the centermost notch 72. The effect is to spread the wires outwardly from the centermost notch. By contrast profile 78 of FIG. 9 has teeth 68 spread outwardly from the centermost notch 72 therein, the effect being to draw the wires inwardly toward the centermost notch. The latter is, of course, appropriate for cable equal to or wider than nominally specified.

In cooperation with the wire locator 64, a signal wire guide 80 is positioned on slide 20 between the wire locator 64 and the connector 28 (FIG. 3). The signal wire guide 80 has alternating V-grooves 82 and scalloped raised portions 84, similar to the V-grooves 40 and raised portions 42 on the connector. Upon being positioned by the wire locator 64, the signal wires of exposed cable segment 58 fall within the V-grooves 82 of the signal wire guide 80, while the ground wires lie upon the raised portions 84 thereof.

Figure 4:
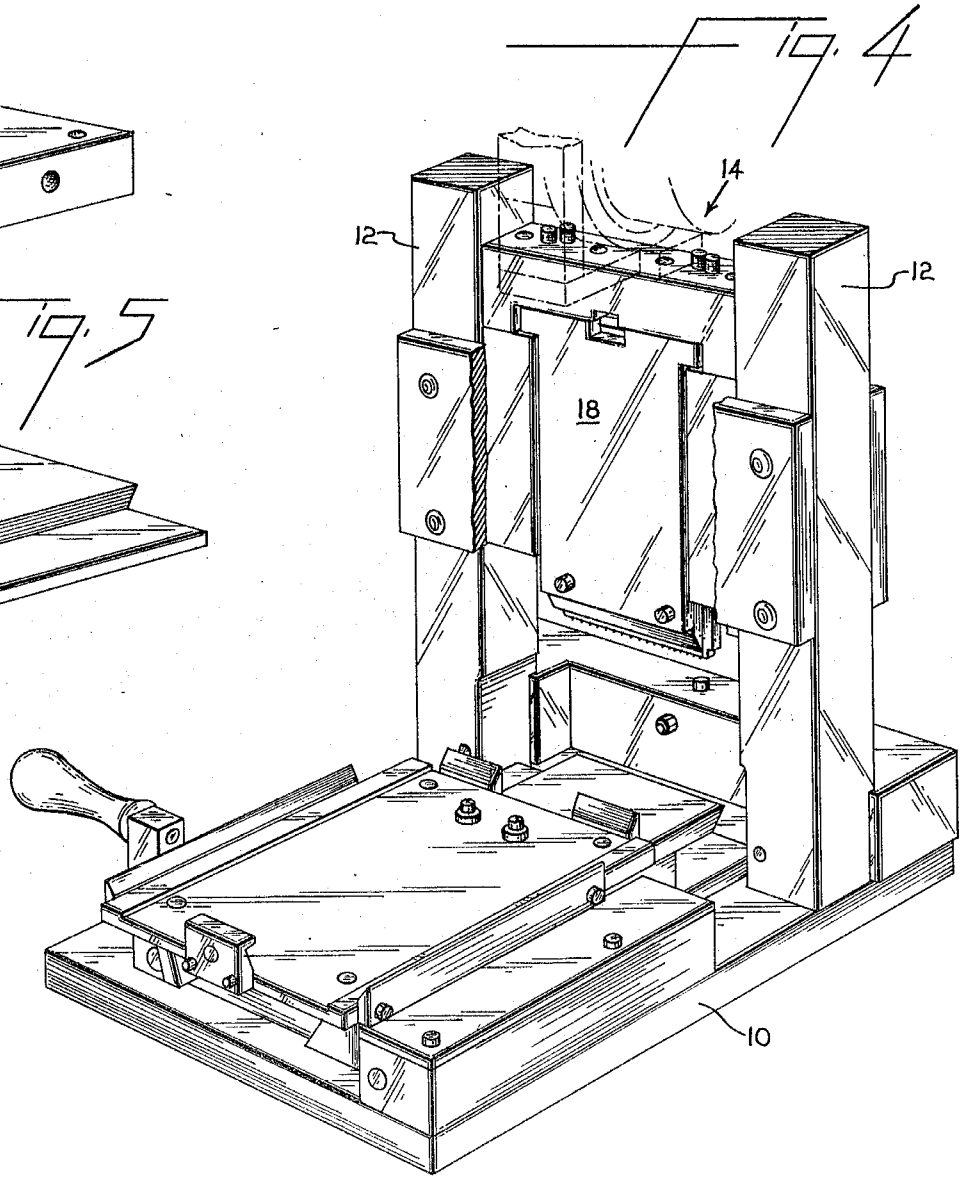
FIG. 4 is a sectioned perspective of the applicator machine of this invention, wherein the punch assembly is revealed.
Figure 5:
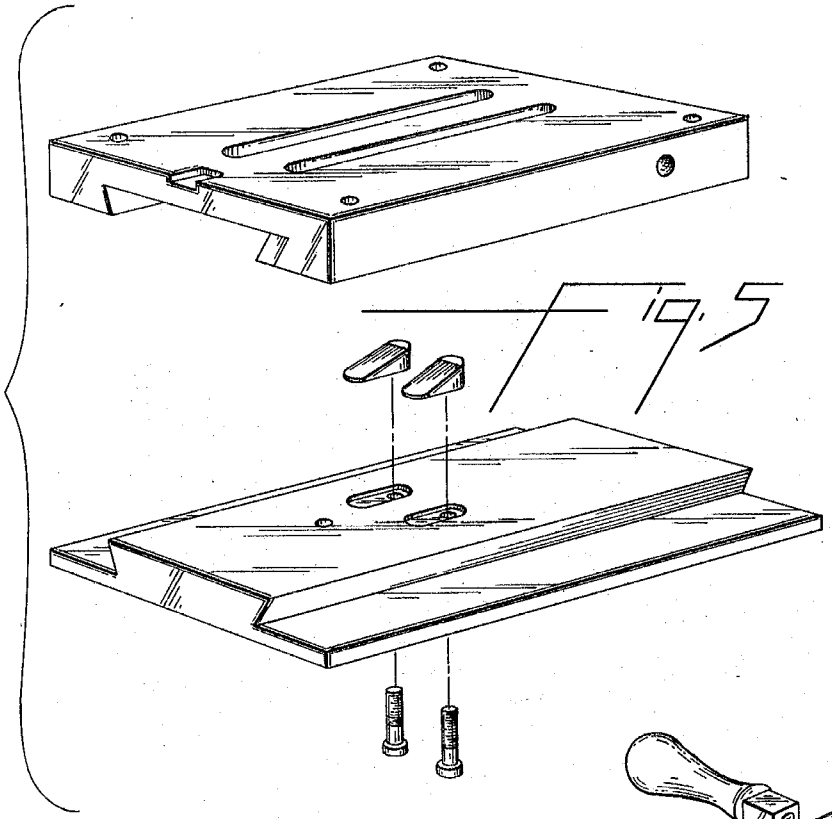
FIG. 5 is an exploded perspective view of the slide and slide base of the applicator machine.
Figure 6:
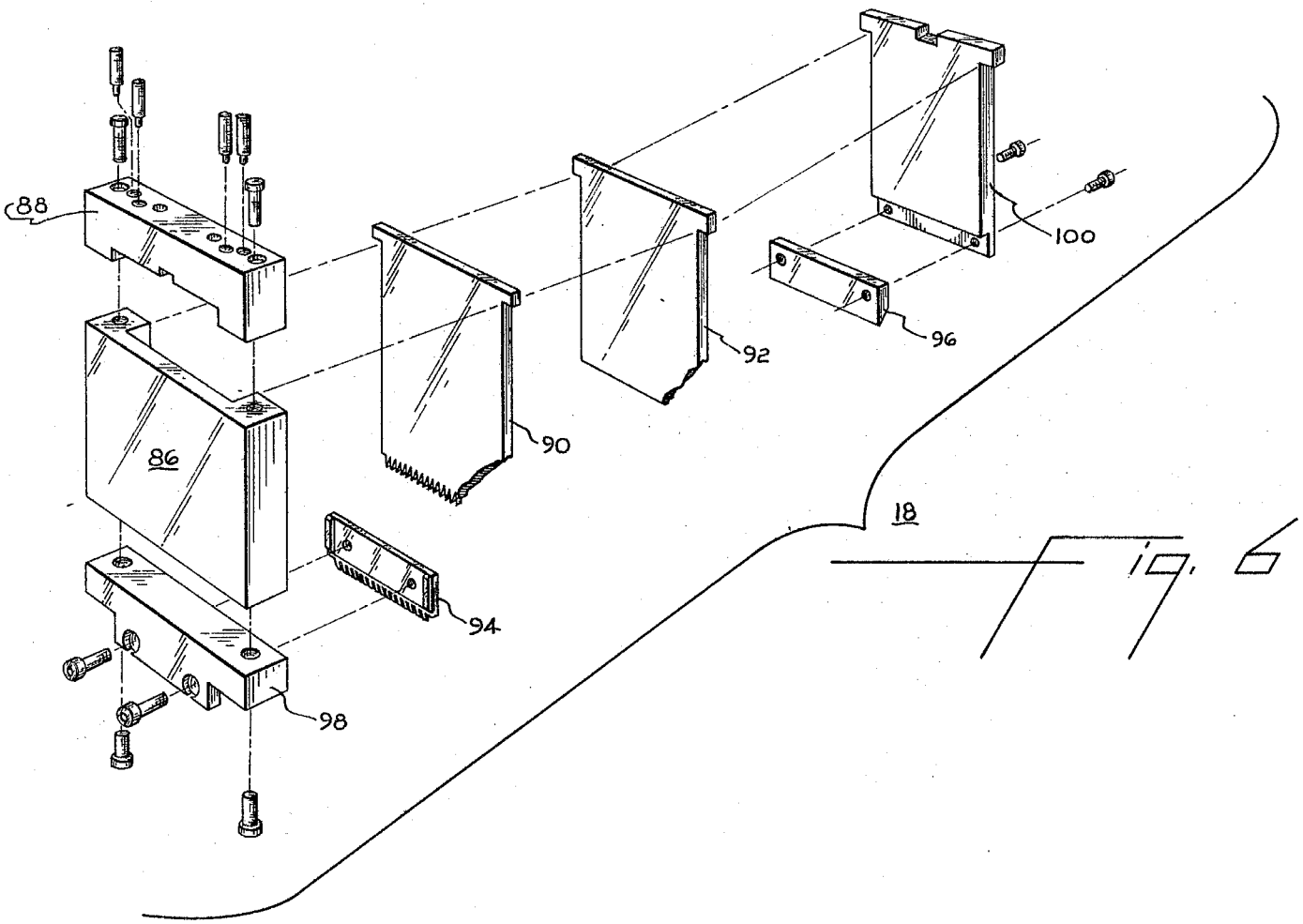
FIG. 6 is an exploded perspective of the punch assembly of the applicator machine.
Figure 7:
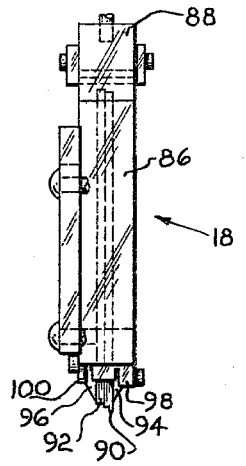
FIG. 7 is a side cross-sectioned view of the punch assembly.

The punch assembly 18 is shown as supported by the bearing assembly 14 in FIG. 4. As mentioned, the punch assembly moves vertically between the guides 12 of the machine. Its stroke is controlled by the hand lever 16 of FIG. 1. The punch assembly is shown in exploded, partially-sectioned perspective view in FIG. 6. A punch holder 86 is affixed to a punch cap 88 which is bolted to the bearing assembly. A signal wire stuffer 90 and buss bar hold down 92 are sandwiched between signal and ground wire cutters 94 and 96, respectively. The latter are held by signal cutter support 98 and ground wire cutter support 100, respectively. An assembled view of the punch assembly 18 is shown in FIG. 7.

Further understanding of the machine of this invention will be gained upon detailed discussion of how cable 22 is terminated to connector 28 by the use of the machine which now follows.

Referring to FIG. 3 cable 22 is first stripped in the manner previously stated. The stripping involves the cutting and sliding of insulation sheath 50 to form exposed wire segment 58 of the cable. It is important that the insulation is not slid completely off the end of the cable so that unstripped cable wire spacing may remain intact, as shown. A stripper machine which is suitable for this purpose is Model 47A by Carpenter Mfg. Co., Inc.

Next, a connector 28 is positioned within recess 62 for termination to the wires of exposed segment 58. The connector 28 must be positioned within the recess such that the V-grooves 40 and scalloped raised portions 42 are closest to the signal wire guide 80. The exposed segment 58 is positioned longitudinally over the slide 20 between the wire guide 70 and wire locator 64. The cable sheath line 56 of the cable is positioned so as to lie over the laterally extending surface 38 of the connector 28. The exposed cable signal wires then lie over the tails 48 (FIG. 2) extending from the terminals (now shown) of connector 28. The cable 22 is clamped to the slide 20 via clamp 24.

Next, the legs 46 of a buss bar 30 are seated into connector openings 44 as may be seen in FIG. 2. The lever 16 (FIG. 1) is then stroked through one cycle; in this embodiment, from extreme upward position to extreme downward position and return. This action moves the punch assembly 18 to its full downward position and returns it to full upward position. During the downward stroke of the cycle, the buss bar 30 is pressed into position by the buss bar hold down 92 (FIGS. 6 and 7), thus clamping the insulated cable segment 34 between buss bar 30 and the laterally extending surface 38 of the connector. The signal wires are terminated by contact to the terminal tails 48 via the signal wire stuffer 90 which also forces and lodges the signal wires into the V-grooves 40 of the connector 28. At the bottom of this stroke that portion of each signal wire which extends beyond each V-groove 40 is severed by the signal wire cutter 94. In the return stroke, the punch assembly 18 is raised from the connector and cable, leaving the cable being held together by its ground wires, and having its signal wires cut and terminated to the tails 48 of the connector 28.

At this point, the unclamped end of the cable is clasped by the stripped insulation sheath 50, and is folded back over the buss bar 30 toward the clamped end of the cable 22. This action reverse bends the ground wires of the cable over the buss bar 30 for termination thereto. As the ground wires lie over the buss bar 30, the lever 16 is then stroked through a second cycle during which the ground wires are terminated to the buss bar 30 by the buss bar hold down 92 and then cut by the ground wire cutter 96. This completes the mass terminations of cable signal and ground wires to the connector 28. The terminated connector assembly is then removed from the recess 62 and a strain relief 32 is snapped over the assembly as may be seen from FIG. 2.

What is claimed is:

1. In a machine for terminating to a connector a stripped multi-conductor flat transmission line cable having signal and ground wires, said machine having a base for supporting said connector, a slide movably attached to said base and punch guides supported by said base, the improvement comprising a punch assembly including a signal wire stuffer and buss bar hold down, said punch assembly movable on said punch guides, means for moving said punch assembly toward and away from said connector, said slide having a wire locator for separating exposed signal and ground wires, said punch assembly having plural relatively movable plates for terminating the signal and ground wires respectively in successive strokes toward said connector.

2. The machine of claim 1 wherein said wire locator contains teeth outwardly inclined from a center notch to receive exposed wires from a cable having a width equal to or greater than the nominal width of said cable, said locator generally containing other notches between each tooth for alternately receiving signal and ground wires, and wherein said center notch is adapted to receive said center-most cable ground wires.

3. The machine of claim 1 wherein said wire locator contains teeth inwardly inclined toward a center notch to receive exposed wires from a cable having a width equal to or less than the nominal width of said cable, said locator generally containing other notches between each tooth for alternately receiving signal and ground wires and wherein said center notch is adapted to receive said center-most cable ground wires.

* * * * *